US007061349B2

(12) United States Patent
Castonguay et al.

(10) Patent No.: US 7,061,349 B2
(45) Date of Patent: Jun. 13, 2006

(54) CIRCUIT BREAKER CONFIGURED TO BE REMOTELY OPERATED

(75) Inventors: Roger Castonguay, Terryville, CT (US); Joseph G. Nagy, Southington, CT (US); Narayansamy Soundararajan, Andhra Pradesh (IN); Dennis Zuffelato, Kensington, CT (US); Craig B. Williams, Avon, CT (US); Heather Pugliese, Amston, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/907,202

(22) Filed: Mar. 24, 2005

(65) Prior Publication Data

US 2005/0212628 A1 Sep. 29, 2005

Related U.S. Application Data

(60) Provisional application No. 60/557,226, filed on Mar. 29, 2004.

(51) Int. Cl.
*H01H 75/00* (2006.01)

(52) U.S. Cl. ..... 335/14; 335/68

(58) Field of Classification Search ..... 335/14, 335/20

See application file for complete search history.

(56) References Cited

U.S. PATENT DOCUMENTS

| | | | | |
|---|---|---|---|---|
| 2,961,068 | A * | 11/1960 | Yarrick et al. | 185/40 R |
| 4,343,030 | A * | 8/1982 | Date et al. | 361/620 |
| 4,679,016 | A | 7/1987 | Ciarcia et al. | 335/132 |
| 5,408,208 | A * | 4/1995 | DiMarco et al. | 335/14 |
| 5,532,660 | A * | 7/1996 | Smith et al. | 335/14 |
| 5,861,784 | A * | 1/1999 | Heise et al. | 335/20 |

* cited by examiner

*Primary Examiner*—Lincoln Donovan
(74) *Attorney, Agent, or Firm*—Cantor Colburn LLP

(57) ABSTRACT

A circuit breaker configured to be remotely operated is disclosed. The circuit breaker includes a set of main contacts configured to connect between an electrical source and an electrical load, an operating mechanism in operable communication to open and close the main contacts, and a remotely operable drive system configured to open and close the main contacts separate from actuation of the operating mechanism. The drive system includes a motor responsive to first and second control signals, a primary drive responsive to the motor, and an opening spring responsive to the primary drive, the main contacts being responsive to the opening spring. In response to the first control signal, the primary drive moves to charge the opening spring, and in response to the second control signal and the main contacts being closed, the primary drive moves to allow the opening spring to discharge thereby resulting in the main contacts opening independent of the motor.

22 Claims, 15 Drawing Sheets

CIRCUIT BREAKER CONFIGURED TO BE REMOTELY OPERATED

CROSS REFERENCE TO RELATED APPLICATIONS

This application claims the benefit of U.S. Provisional Application Ser. No. 60/557,226, filed Mar. 29, 2004, which is incorporated herein by reference in its entirety.

BACKGROUND OF THE INVENTION

The present disclosure relates generally to circuit breakers, and particularly to circuit breakers configured to be remotely operated.

Electrical panels typically house a plurality of circuit breakers that distribute power from a source to a plurality of loads while providing protection to the load circuits. The electrical panels may be single-phase, three-phase, or three-phase with switching neutral, may have a variety of voltage ratings, such as 120 Vac to 600 Vac for example, and may have a variety of current ratings, such as 125 Amps to 400 Amps for example, thereby enabling the electrical panels to serve a variety of applications. One such application is a lighting panel, which may be used to service lighting loads in a commercial building having a plurality of lighting circuits. To facilitate the efficient utilization of power in such commercial buildings, remote operated circuit breakers (ROCBs) may be employed that enable the lighting loads to be turned on and off from a location remote to the electrical panel or from within the electrical panel. During the operation of a ROCB, it is desirable to be able to rapidly open and rapidly close the main breaker contacts while the main breaker operating mechanism is in the on position. It is also desirable to be able to decouple the ROCB drive system from the main contacts when the main breaker operating mechanism is in the off or tripped position. While different types of ROCBs may employ different types of drive systems, such as solenoids and electric motors for example, not all drive systems lend themselves to perform as desired without the introduction of complex and costly subsystems. Accordingly, there is a need in the art for a ROCB that overcomes these drawbacks.

BRIEF DESCRIPTION OF THE INVENTION

An embodiment of the invention includes a circuit breaker configured to be remotely operated. The circuit breaker includes a set of main contacts configured to connect between an electrical source and an electrical load, an operating mechanism in operable communication to open and close the main contacts, and a remotely operable drive system configured to open and close the main contacts separate from actuation of the operating mechanism. The drive system includes a motor responsive to first and second control signals, a primary drive responsive to the motor, and an opening spring responsive to the primary drive, the main contacts being responsive to the opening spring. In response to the first control signal, the primary drive moves to charge the opening spring, and in response to the second control signal and the main contacts being closed, the primary drive moves to allow the opening spring to discharge thereby resulting in the main contacts opening independent of the motor.

Another embodiment of the invention includes a multi-pole circuit breaker configured to be remotely operated. The multi-pole circuit breaker includes a master pole and a slave pole, each pole comprising a set of main contacts configured to connect between an electrical source and an electrical load, an operating mechanism in operable communication to open and close the associated main contacts, and a primary drive in operable communication to open and close the associated main contacts separate from actuation of the associated operating mechanism. A mechanism tie is disposed to operate the master and slave mechanisms together. The master pole further includes a remotely operable motor in operable communication with the master primary drive, and in operable communication with the slave primary drive via a connecting gear. The motor is responsive to first and second control signals to open and close the master and slave main contacts separate from actuation of the master or slave operating mechanisms.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention provides a remote operated circuit breaker (ROCB) having a unidirectional motor and drive gear that drive a cam and cam follower. The cam follower actuates a crank assembly that serves to charge an opening spring, close the main contacts of the circuit breaker, and open the main contacts of the circuit breaker. The crank assembly interfaces with the main contacts via an intermediate crank and a mechanism crank. The unidirectional drive system of the ROCB is effective to open and close the main contacts only when the circuit breaker operating mechanism is in the on position. In the event that the operating mechanism is in the off or trip position, a decoupler serves to decouple the ROCB unidirectional drive system from the main contacts, thereby preventing the ROCB drive system from operating the main contacts in the event that the circuit breaker is off or tripped. The opening spring and the crank assembly are configured such that the opening and closing action of the main contacts via the ROCB drive system occurs in a quick-make and quick-break fashion. A status indicator flag provides a technician with visual indication of the status of the contacts. A status switch provides status logic to a controller for timely on/off control of power to the motor. A multipole ROCB may be configured by ganging together multiple single pole ROCBs, where only one of the poles, the master pole, which is usually the center pole, has the unidirectional motor. The other poles, the slave poles, are absent the unidirectional motor, being driven instead by a connecting gear that engages with the gear system of the master pole. A common trip bar provides the appropriate logic for common tripping of all poles. To ensure proper alignment and synchronization of all gears in all poles of a multipole ROCB, an alignment clip is used during assembly to position the gears in a set position. Once the multipole ROCB is assembled and operated once, the alignment clip is automatically repositioned out of the way to a non-engaging position. While embodiments described herein depict a ROCB having a specific operating mechanism and main contact structure, it will be appreciated that the disclosed invention may also be applicable to other ROCBs having different operating mechanism and main contact structures.

Figure 1:
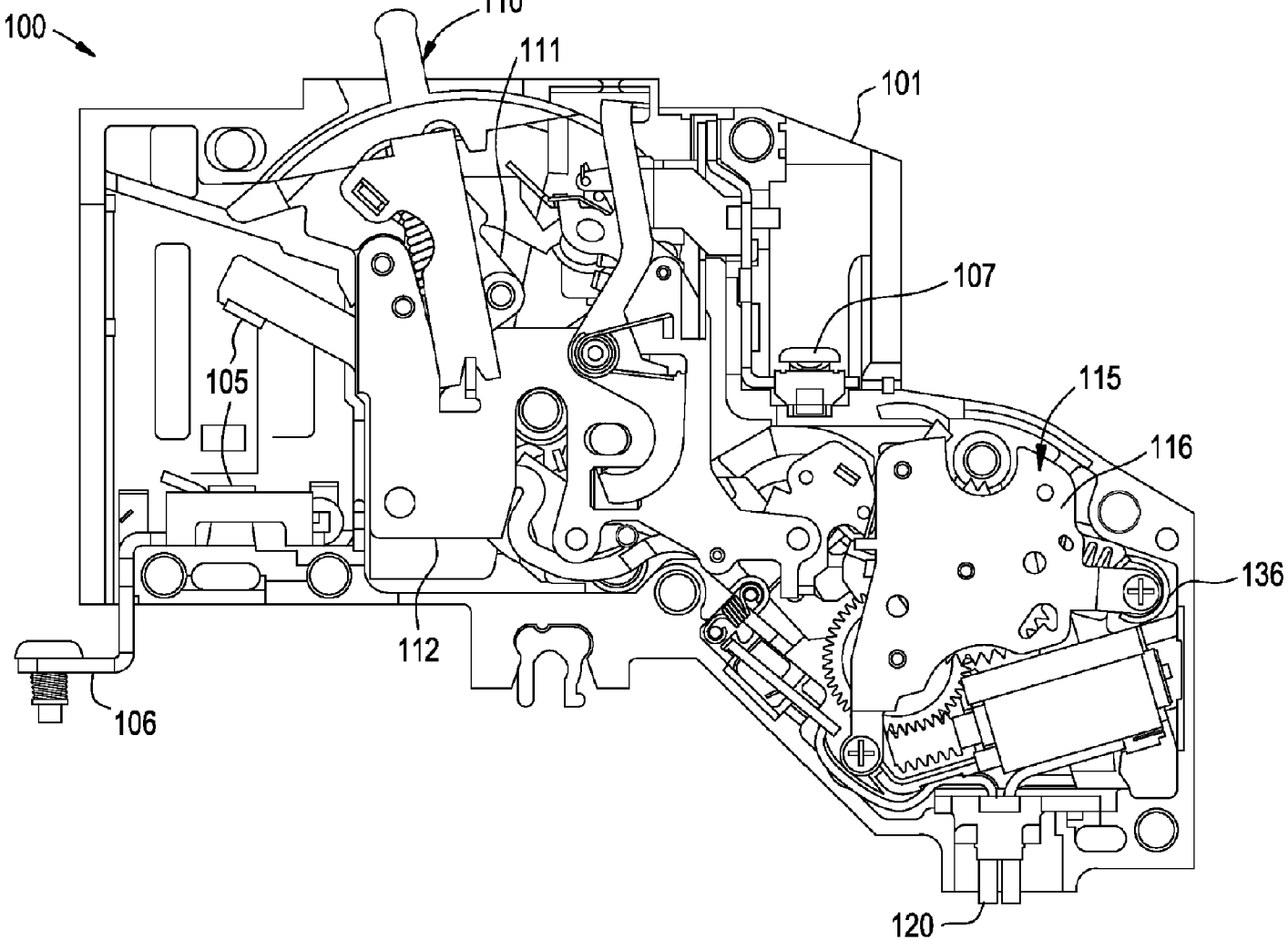
FIG. 1 depicts an exemplary remote operated circuit breaker (ROCB) in accordance with an embodiment of the invention.

FIG. 1 is an exemplary embodiment of a ROCB 100 having a set of main contacts 105 configured to connect between an electrical source (not shown but well known in the art) and an electrical load (not shown but well known in the art) via line and load terminals 106, 107, an operating mechanism 110 in operable communication to open and close the main contacts 105, and a remotely operable drive system 115 (discussed in more detail below) configured to open and close the main contacts 105 separate from actuation of the operating mechanism 110. The drive system 115 receives control signals from a controller (not shown) via a communication port 120.

In an exemplary embodiment, operating mechanism 110 operates in a manner described in commonly assigned U.S. Pat. No. 4,679,016, which is incorporated herein by reference in its entirety.

As a general note, and for descriptive purposes, the several figures described herein depict ROCB 100 and various components of ROCB 100 in either a left side view or a right side view. As used herein, a left side view refers to a view from the left pole side of the circuit breaker with the main contacts 105 toward the left side of the figure, and a right side view refers to a view from the right pole side of the circuit breaker with the main contacts 105 toward the right side of the figure. As such, FIG. 1 is considered to be a left side view. Furthermore, operable descriptions of an embodiment of the invention are provided herein with reference to a particular view, which means that a clockwise movement in a left side view is the same as a counter-clockwise movement in a right side view.

Figure 2:
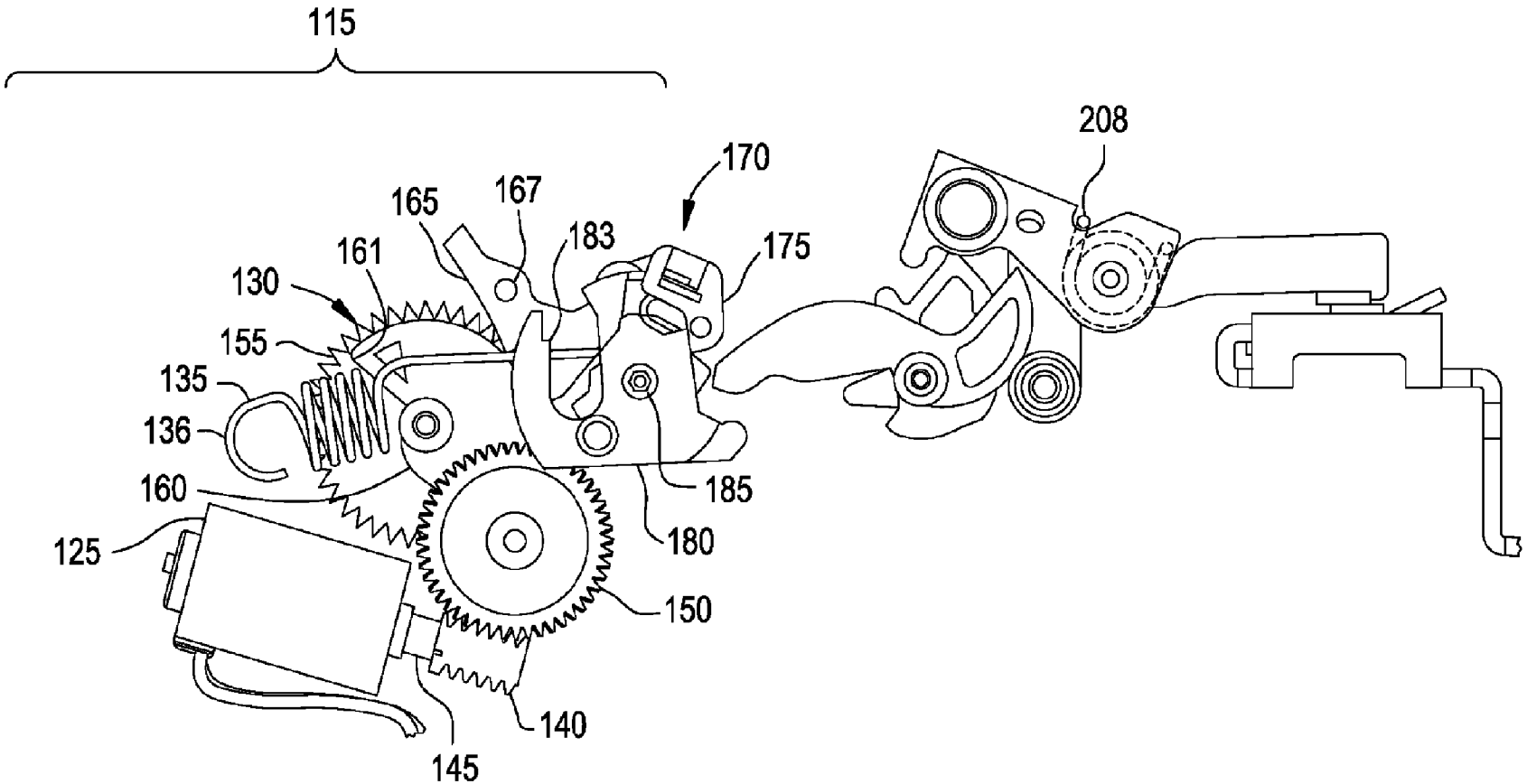
FIG. 2 depicts a portion of the ROCB of FIG. 1 and includes a drive system in accordance with an embodiment of the invention.

Referring now to FIG. 2 (right side view), the drive system 115 includes a unidirectional motor 125 responsive to first and second control signals, a primary drive 130 responsive to the motor 125, and an opening spring 135 responsive to the primary drive 130. As will be discussed in more detail below, the main contacts 105 are responsive to the opening spring 135. The motor 125 has a gear drive, such as a worm drive 140, in fixed relation with the motor shaft 145 that drives the primary drive 130. The primary drive 130 includes a worm gear 150, a cam gear 155 having an integrally arranged cam profile (cam) 160, a cam follower (follower) 165 being biased to follow the cam 160, and a drive crank system 170 responsive to the follower 165, which is best seen by now referring to FIGS. 3–5 collectively.

Figure 3:
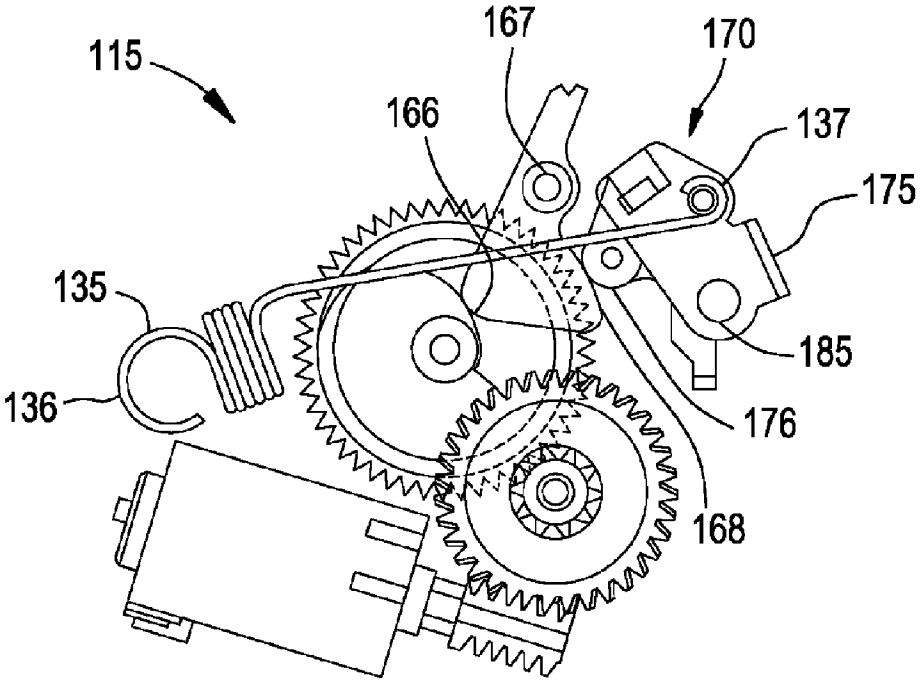
FIG. 3 depicts a portion of the drive system of FIG. 2.
Figure 4:
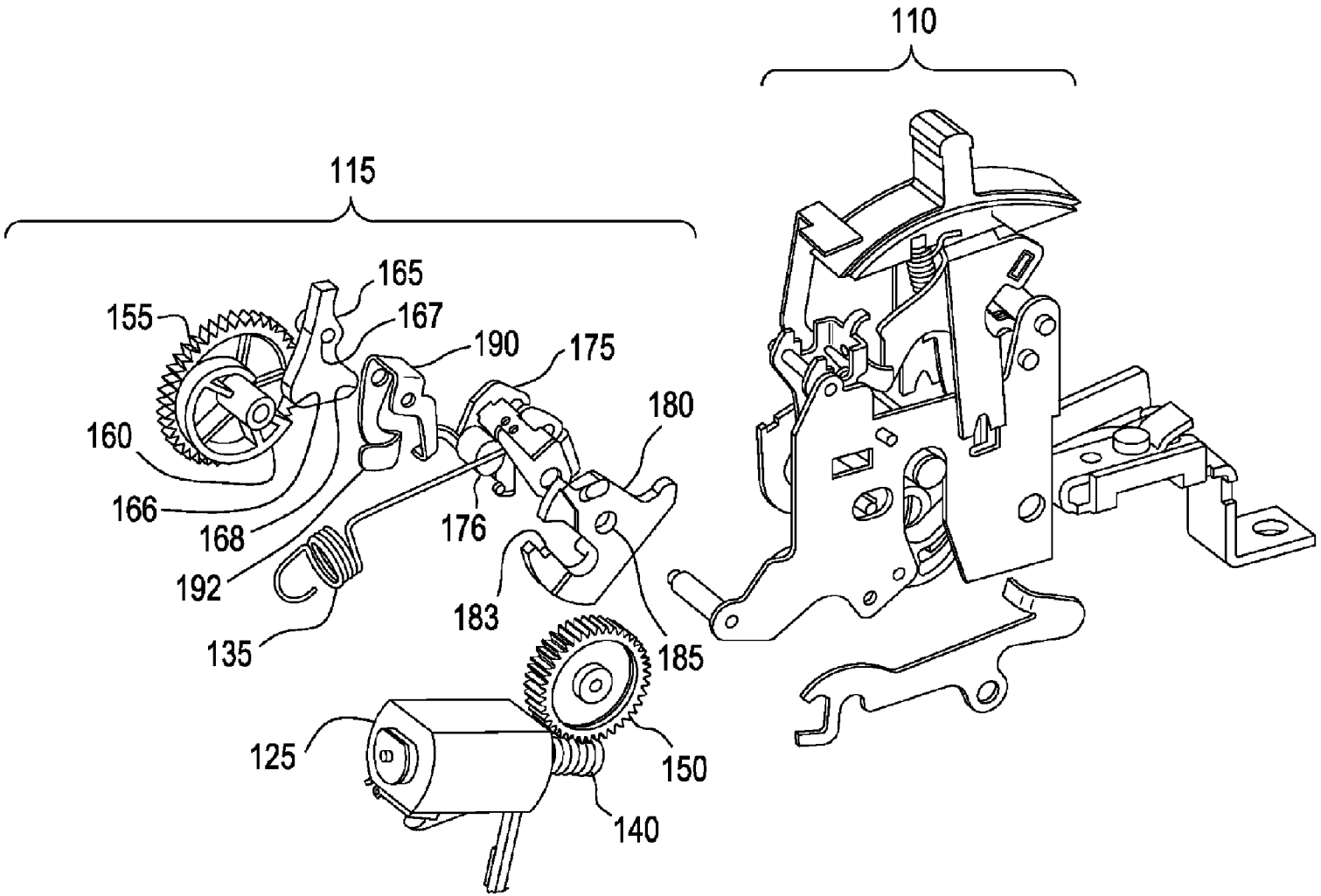
FIG. 4 depicts an isometric exploded assembly view of a portion of the ROCB of FIG. 1 and similar to the portions depicted in FIG. 2.

FIG. 3 (right side view) depicts a partial view of drive system 115 with opening spring 135. FIG. 3 is a partial view in that the drive crank system 170 shows only a first crank 175. A second crank 180 is depicted in FIG. 4 (right side isometric view) and has the same pivot 185 as first crank 175. Second crank 180 is spring biased clockwise with respect to first crank 175 until stop surface 181 of second crank 180 engages a drive plate 195, best seen by referring to FIG. 5 (right side isometric view). Drive plate 195 has one end 196 pivotally arranged with first crank 175, and is spring biased downward such that a central portion 197 engages with pocket 177 of first crank 175. Opening spring 135 has one end 136 anchored to a boss (not shown) in housing 101 (see FIG. 1) and another end 137 anchored to drive crank system 170. Also depicted in FIG. 4 is a blocking prop 190, which will be discussed in more detail below. Unless otherwise specified, all pivotally arranged components are pivotally arranged with respect to a fixed reference, such as the housing 101 of the circuit breaker, or mounting frames therein, for example.

Follower surface 166 of cam follower 165 is biased against cam 160, such that as motor 125 drives worm drive 140, worm gear 150 rotates cam gear 155 clockwise (reference to FIGS. 2–4), causing cam follower 165 to rotate counterclockwise about pivot 167 as surface 166 follows cam profile 160, which causes follower drive surface 168 to drive crank pin 176 that in turn rotates first crank 175 clockwise about pivot 185. As first crank 175 rotates clockwise, opening spring 135 is charged and reaches a full charge when follower 165 rides on the dwell of cam 160.

Figure 5:
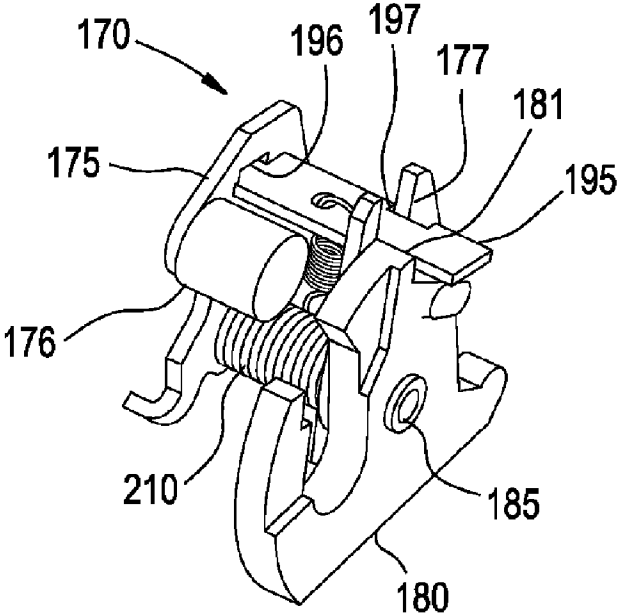
FIG. 5 depicts an isometric view of a drive crank system in accordance with an embodiment of the invention.

In response to the motor 125 receiving an open signal, and in reference now to FIG. 2, cam gear 155 is driven clockwise until cam follower 165 traverses a drop-off shelf 161 on cam 160, at which time opening spring 135 discharges causing drive crank system 170 (both first crank 175 and second crank 180 under the engagement of drive plate 195, best seen by referring to FIG. 5) to rapidly rotate counter-clockwise about pivot 185 independent of the speed of motor 125. During the counter-clockwise rotation of second crank 180, and with reference now to FIG. 6 (right side view), drive surface 182 of second crank 180 engages with a first end 201 of intermediate crank 200 causing intermediate crank 200 to rotate clockwise about pivot 202. A second end 203 of intermediate crank 200 has a cam surface that engages with a roller 206 on contact arm 205, which supports one of the main contacts 105, thereby causing contact arm 205 to rotate counter-clockwise about pivot 207, resulting in main contacts 105 rapidly opening and being held open by intermediate crank 200, drive crank system 170, and opening spring 135. As a result of the aforementioned opening action, a quick break of the main contacts 105 is achieved.

In view of the foregoing description, it will be appreciated that in response to a first control signal (a charge signal) at motor 125, the primary drive 130 (including cam 160 and follower 165) moves to charge the opening spring 135, and in response to a second control signal (an open signal) and with the main contacts 105 being initially closed, the primary drive 130 (also including first and second cranks 175, 180) moves in the same direction to cause the follower 165 to traverse a drop-off shelf 161 that allows the stored energy in the opening spring 135 to rapidly discharge, thereby resulting in the main contacts 105 being rapidly driven open independent of the speed of the motor 125.

Also in response to the first control signal, and with the main contacts 105 starting from a held open condition, the drive system 115 serves to close the main contacts 105, which will now be discussed with primary reference to FIG. 6.

Figure 6:
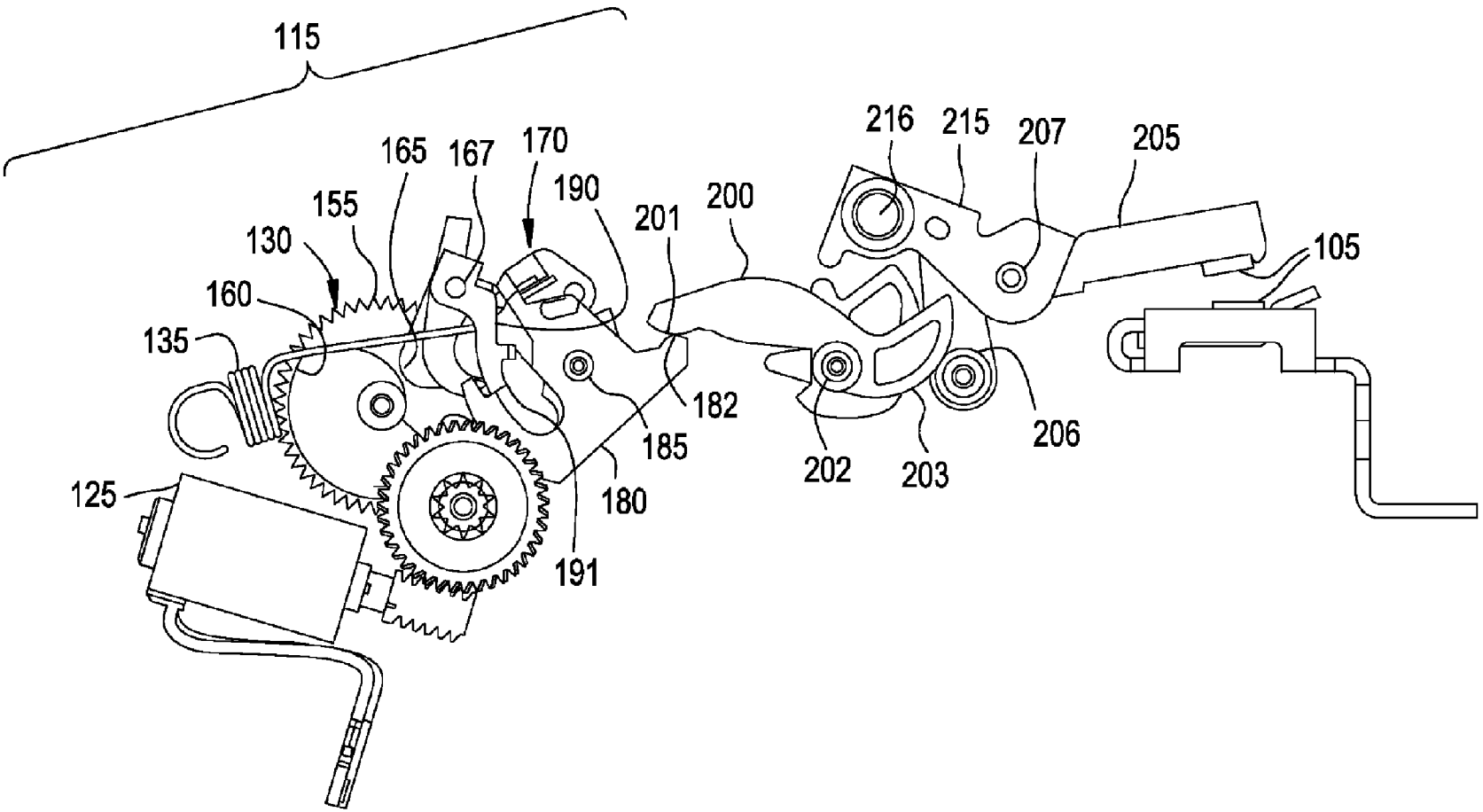
FIG. 6 depicts a view similar to that of FIG. 2, but with components in an alternative position.

In response to motor 125 receiving a first signal (also herein referred to as a charge-and-close signal), and with reference now to FIG. 6, drive system 115 moves to rotate cam gear 155 clockwise such that cam 160 causes cam follower 165 to rotate counter-clockwise about pivot 167, which in turn causes first crank 175 to charge opening spring 135 as discussed previously. However, during this action a catch surface 191 of blocking prop 190 engages with a latch surface 183 (best seen by referring to FIGS. 2 and 4) of second crank 180, thereby preventing second crank 180 from rotating clockwise with first crank 175 and causing crank spring 210 (depicted in FIG. 5) to charge. At a point when cam follower 165 is riding on a dwell of cam 160 and opening spring 135 is fully charged, blocking prop 190 is kicked out of engagement with second crank 180 by way of cam 160 engaging with kick surface 192 (see FIG. 4) to rotate blocking prop 190 counter-clockwise about pivot 167. Since operating mechanism 110 is in the on position, so also is mechanism crank 215, which is coupled to operating mechanism 110 via linkage 111 (depicted in FIG. 1) and is rotated clockwise about pivot 216 to cause a contact spring 208 (depicted in FIG. 2) to be charged and to exert a clockwise bias moment on contact arm 205 about pivot 207. With the removal of the hold condition between blocking prop 190 and second crank 180, intermediate crank 200 is allowed to rotate counter-clockwise about pivot 202 under the influence of the stored energy in the contact spring 208 driving contact arm 205 clockwise about pivot 207, and roller 206 driving against second end 203 of intermediate crank 200. As a result, and under the influence of stored energy in contact spring 208, second crank 180 is driven by roller 206 and intermediate crank 200 to rotate clockwise about pivot 185 resulting in drive surface 182 of second crank 180 being rotated out of the path of first end 201 of intermediate crank 200. As a result of the aforementioned closing action, a quick make of the main contacts 105 is achieved.

In view of the foregoing description, it will be appreciated that in response to the first control signal (a charge-and-close signal), with the main contacts 105 being held open and the operating mechanism 110 being in the on position, the motor 125 causes the drive crank system 170 (including first crank 175 and second crank 180) to move in a direction to charge the opening spring 135 while the blocking prop 190 serves to temporarily block movement of the second crank 180, and in response to the opening spring 135 being fully charged, the motor 125 causes the blocking prop 190 to rapidly release its temporary block of the second crank 180, thereby allowing the stored energy in the contact spring 208 to cause the main contacts 105 to rapidly close under the biasing influence of the contact spring 208 and independent of the speed of the motor 125.

Figure 7:
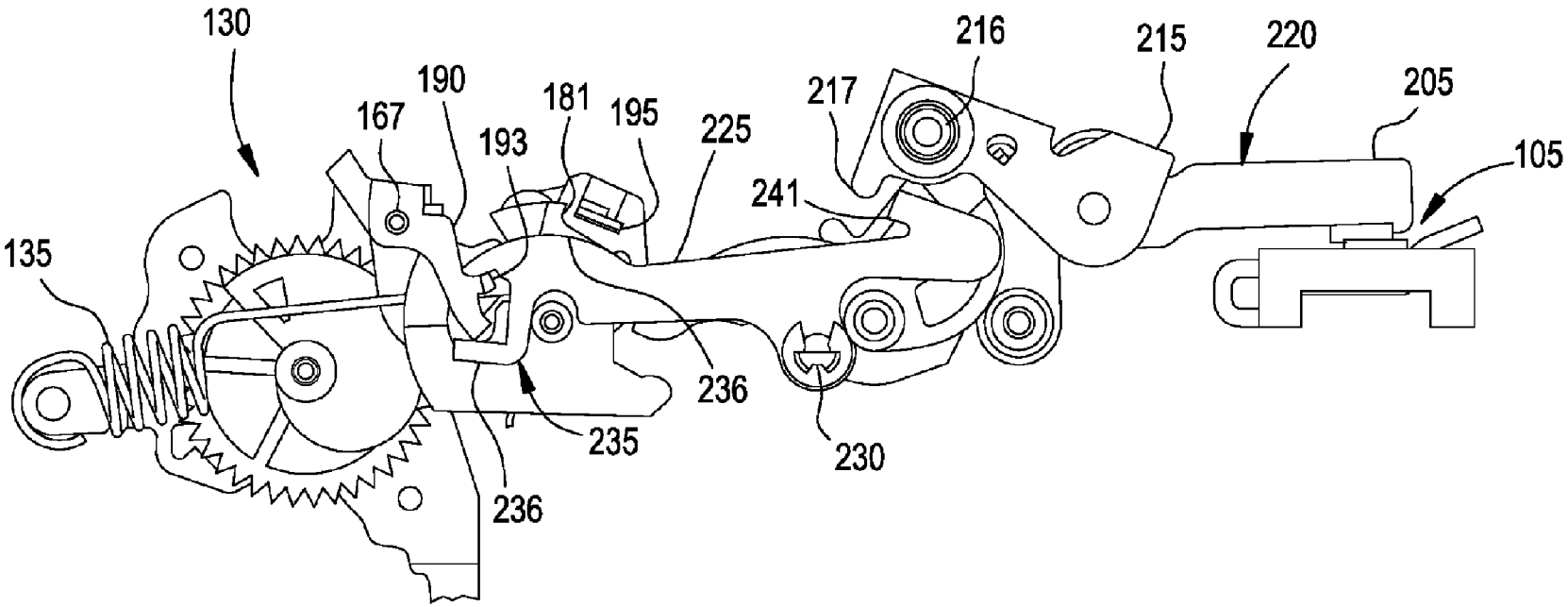
FIG. 7 depicts a view similar to that of FIG. 2, but with a decoupler in accordance with an embodiment of the invention.
Figure 8:
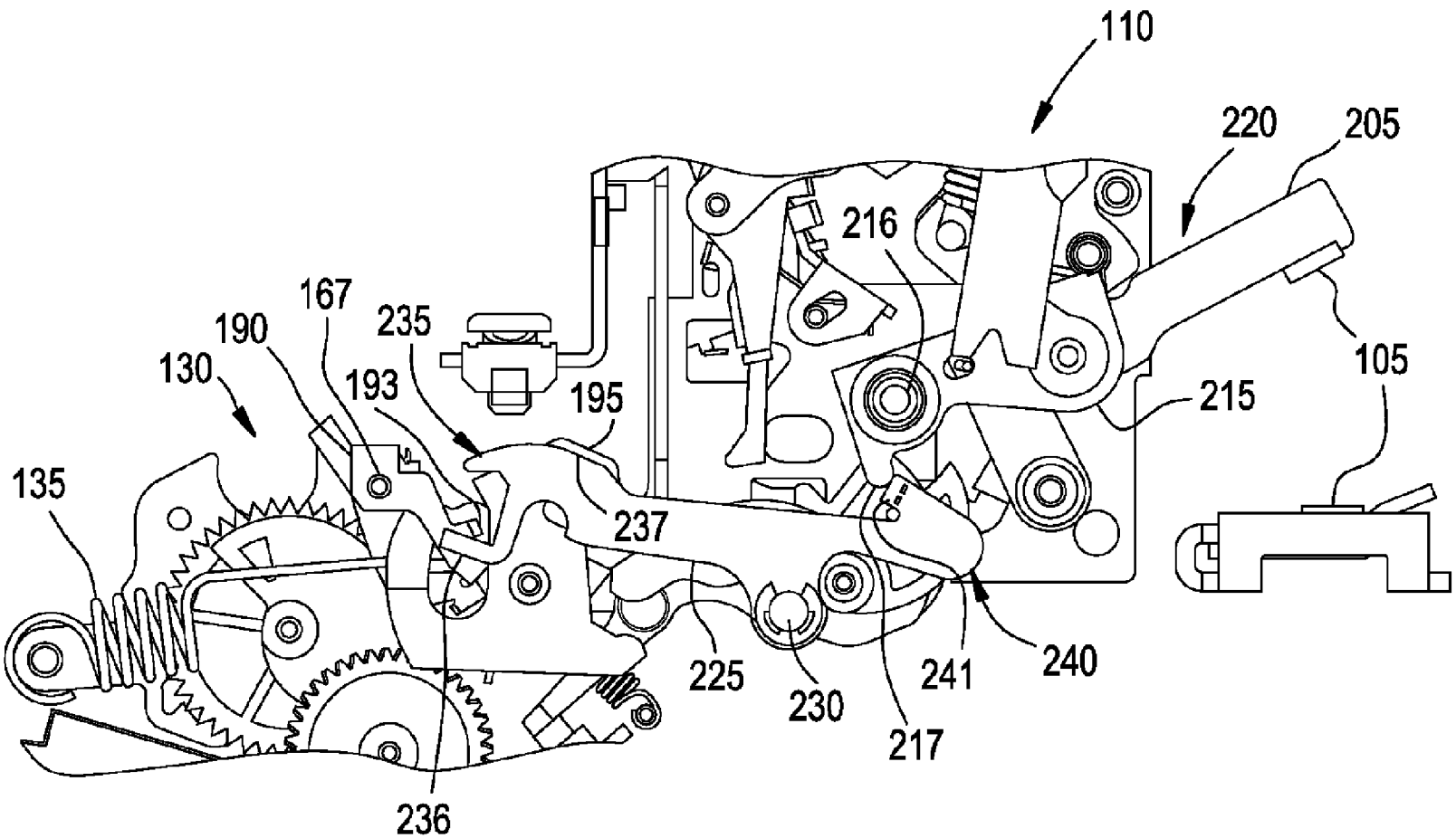
FIG. 8 depicts a view similar to that of FIG. 7, but with components in an alternative position.

Referring now to FIGS. 7 and 8 (right side views), a decoupler system for decoupling the ROCB drive system 115 from the contact arm assembly 220 (contact arm 205, contact spring 208, and mechanism crank 215) will now be discussed. FIG. 7 depicts the operating mechanism 110 in the on position (mechanism crank 215 biased clockwise about pivot 216), the main contacts 105 closed, and the opening spring 135 charged. FIG. 8 depicts the operating mechanism 110 in the off position (mechanism crank 215 biased counter-clockwise about pivot 216), the main contacts 105 open, and the opening spring 135 charged. In both FIGS. 7 and 8, a decoupler 225 rotates about pivot 230 and has a first end 235 that engages with primary drive 130 and a second end 240 that engages with contact arm assembly 220.

Decoupler 225 has an engagement arm 236 at the first end 235 that interfaces with a pick-up tab 193 of blocking prop 190, an engagement surface 237 at the first end 235 that interfaces with drive plate 195 of first crank 175 of drive crank system 170, and an engagement tab 241 at the second end 240 that interfaces with a lobe 217 of mechanism crank 215 (best seen by referring to FIG. 8). As such, decoupler 225 is considered to be in operable communication with the drive crank system 170, the first crank 175, the drive plate 195, the blocking prop 190, and the mechanism crank 215.

In response to operating mechanism 110 being in the on position, and with reference now to FIG. 7, lobe 217 and engagement tab 241 do not engage with each other, and decoupler 225 is free to rotate about pivot 230 until it is stopped by engagement tab 241 hitting a stop surface (not shown but of a configuration known to one skilled in the art) at the mechanism side frame 112 (depicted generally in FIG. 1). As a result, drive plate 195 is fully engaged with pocket 177 of first crank 175, which enables drive plate 195 to engage with stop surface 181 of second crank 180, thereby resulting in the ROCB drive system 115 being operably engaged with the contact arm assembly 220.

In response to the operating mechanism 110 being in the off position, and with reference now to FIG. 8, lobe 217 engages with engagement tab 241 to rotate decoupler 225 clockwise about pivot 230, which causes engagement surface 237 to lift drive plate 195 out of engagement with stop surface 181 of second crank 180, thereby resulting in the ROCB drive system 115 being out of operable engagement with contact arm assembly 220. When decoupled, engagement arm 236 of decoupler 225 also picks up pick-up tab 193 of blocking prop 190, causing blocking prop 190 to rotate counter-clockwise about pivot 167 and out of possible engagement with latch surface 183 of second crank 180, thereby allowing crank spring 210 to bias second crank 180 to move in the same direction as first crank 175.

In view of the foregoing description, it will be appreciated that in response to the operating mechanism 110 being in the on position, the decoupler 225 allows the drive plate 195 to engage the first crank 175 with the second crank 180, which allows engagement of the drive system 115 with the contact arm assembly 220. It will also be appreciated that in response to the operating mechanism 110 being in the off position, the decoupler 225 disallows the drive plate 195 to engage the first crank 175 with the second crank 180, which disallows engagement of the drive system 115 with the contact arm assembly 220, and that in response to the operating mechanism 110 being in the off position and the motor 125 being responsive to the first or the second control signal, the contact arm assembly 220 is non-responsive to the drive system 115. It will be further appreciated that in response to the operating mechanism 110 being in the on position, the decoupler 225 allows the blocking prop 190 to temporarily block the action of the second crank 180 of the drive crank system 170 in response to the drive crank system 170 moving in a direction so as to cause the main contacts 105 to close, and in response to the operating mechanism 110 being in the off position, the decoupler 225 disallows the blocking prop 190 to temporarily block the action of the drive crank system 170 in response to the drive crank system 170 moving in a direction so as to cause the main contacts 105 to close.

The aforementioned discussion has been made with reference to a first control signal (a charge-and-close signal) and a second control signal (an open signal). However, the ROCB drive system 115 also operates by employing motor-off signals, which are controlled using a status switch. In addition to the use of a status switch, a status indicator is employed for providing a user with a visual indication as to the status of the main contacts 105, which will both now be discussed in more detail.

Figure 9:
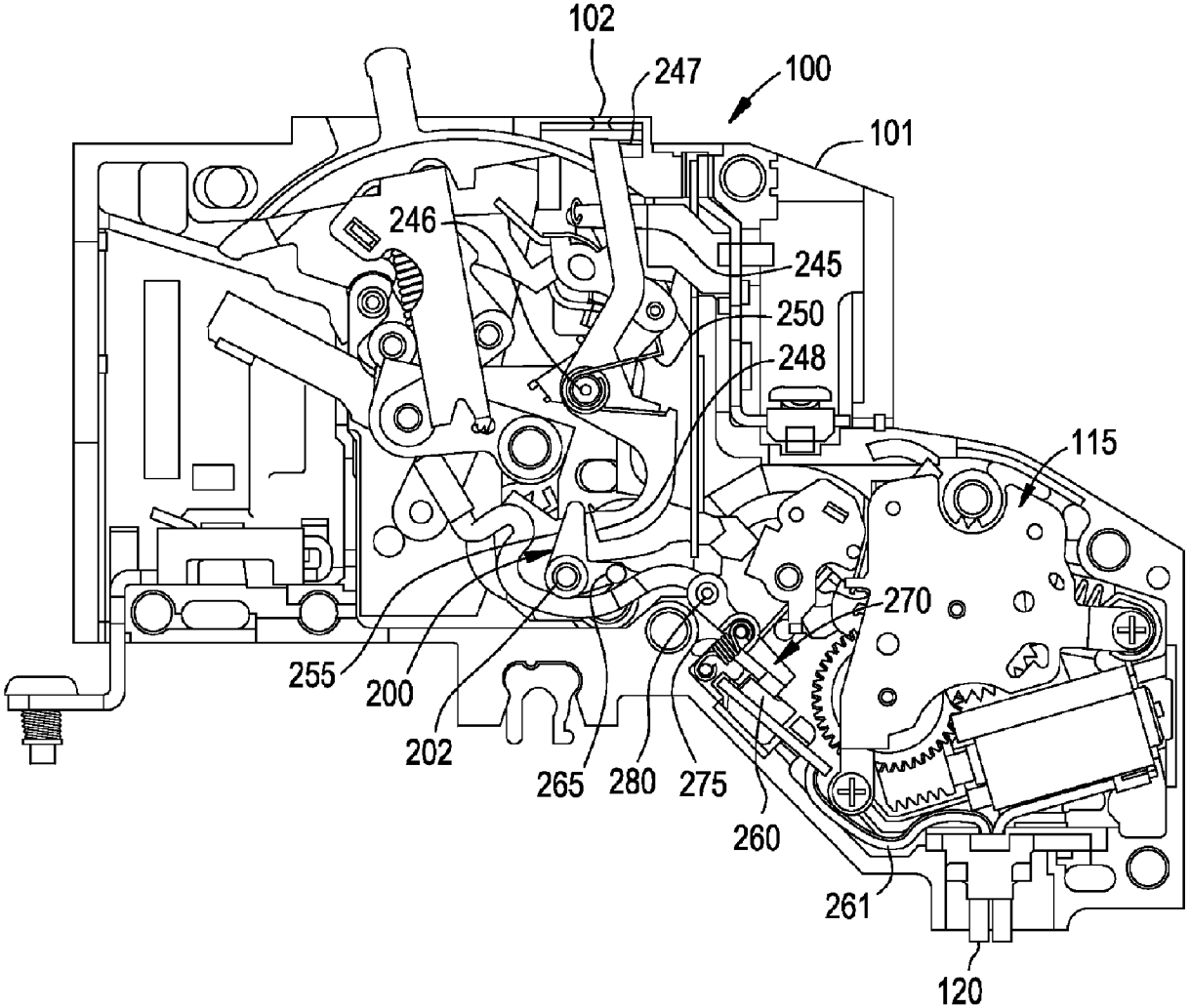
FIG. 9 depicts a view similar to that of FIG. 1, but with parts removed to show further detail.
Figure 10:
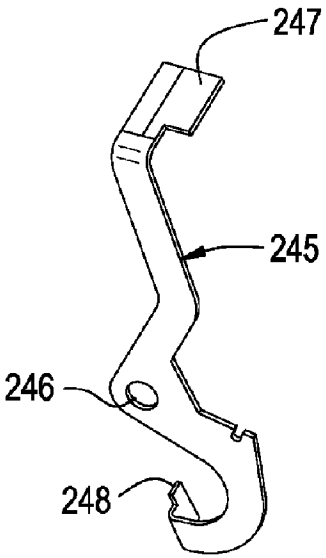
FIG. 10 depicts an isometric view of a status indicator in accordance with an embodiment of the invention.

Referring now to FIG. 9 (left side view), an embodiment of ROCB 100 includes a status indicator 245, also depicted in FIG. 10 (left side isometric view), that is biased via a spring 250 to rotate clockwise about pivot 246 until flag 247 at a top end of status indicator 245 is bottomed out on the housing 101 of ROCB 100. FIG. 9 illustrates the position of status indicator 245 when the operating mechanism 110 of ROCB 100 is in the tripped position. However, as will be discussed in more detail below, FIG. 9 is also illustrative of the position of status indicator 245 when the operating mechanism 110 is in the off position, or is in the on position with the main contacts 105 held open via the drive system 115. Flag 247 is visible to a user via a window 102 in housing 101, and is appropriately color coded to indicate the condition of the main contacts 105, such as green for open and white for closed, for example.

Figure 11:
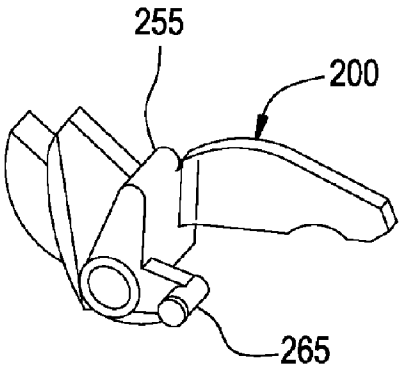
FIG. 11 depicts an isometric view of an intermediate crank in accordance with an embodiment of the invention.
Figure 12:
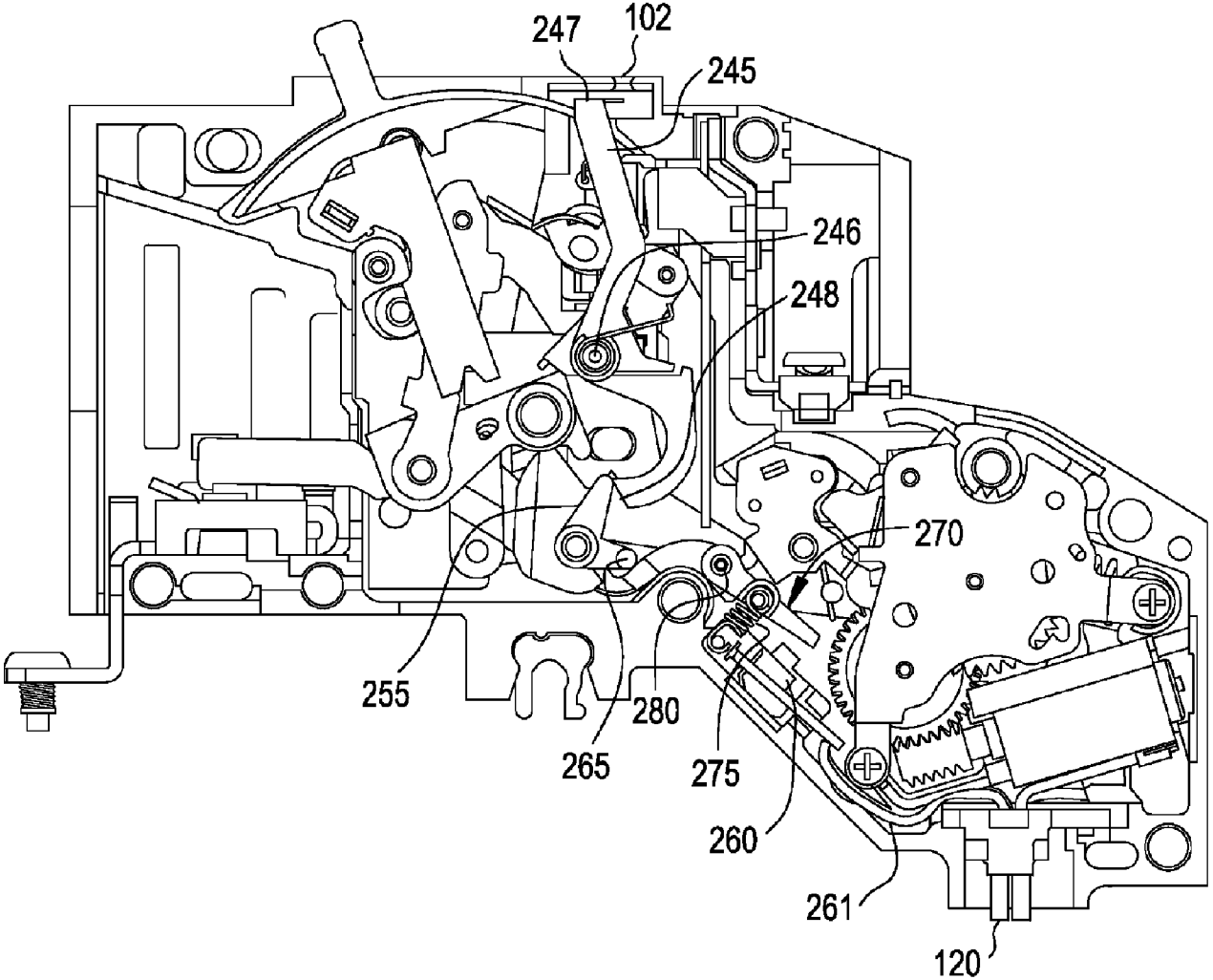
FIG. 12 depicts a view similar to that of FIG. 9, but with components in an alternative position.

At a bottom end of status indicator 245 is an actuator tab 248 that is disposed to interface with a flag arm 255 of intermediate crank 200, also depicted in FIG. 11 (left side isometric view). When intermediate crank 200 is biased clockwise about pivot 202 (with reference to FIG. 9), flag arm 255 drives status indicator 245 counter-clockwise about pivot 246, which is best seen by referring to FIG. 12 (left side view), thereby changing the position of flag 247 in window 102.

When ROCB drive system 115 is engaged, as described above, intermediate crank 200 rotates counter-clockwise (reference to FIGS. 9 and 12) to open the main contacts 105, and rotates clockwise to close the main contacts 105. Hence, when ROCB drive system 115 is engaged, indicator flag 245 is driven counter-clockwise via flag arm 255 in response to the main contacts 105 being closed, and is driven clockwise via spring 250 in response to the main contacts 105 being open.

When ROCB drive system 115 is disengaged, as described above, intermediate crank 200 is decoupled from drive system 115, but is still positionable by roller 206 of contact arm 205 (see FIG. 6). In response to roller 206, intermediate crank 200 rotates clockwise (reference to FIGS. 9 and 12) in response to main contacts 105 being closed via operating mechanism 110, thereby driving status indicator 245 counter-clockwise, and intermediate crank 200 is free to rotate counter-clockwise (reference to FIGS. 9 and 12) in response to main contacts 105 being open via operating mechanism 110, thereby permitting spring 250 to bias status indicator 245 clockwise.

In view of the foregoing description, it will be appreciated that the status indicator 245 is in operable communication with the intermediate crank 200 and is configured to indicate a closed main contact condition in response to the operating mechanism 110 being in the on position and the main contacts 105 being closed, and to indicate an open main contact condition in response to the operating mechanism 110 being in the on position and the main contacts 105 being held open.

Figure 13:
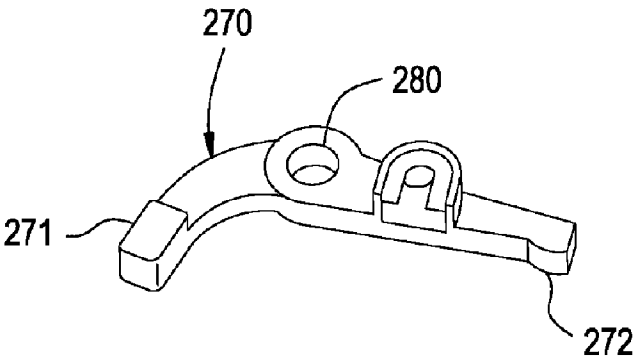
FIG. 13 depicts an isometric view of a switch lever in accordance with an embodiment of the invention.

The above described interaction between intermediate crank 200 and status indicator 245 via flag arm 255, also applies to the interaction between intermediate crank 200 and a status switch 260 (depicted in FIGS. 9 and 12) via switch arm 265 of intermediate crank 200 and a switch lever 270. Switch lever 270, also depicted in FIG. 13 (left side isometric view), is biased via spring 275 to rotate clockwise (with reference to FIGS. 9 and 12) about pivot 280. In response to intermediate crank 200 being driven to rotate clockwise (with reference to FIGS. 9 and 12), switch arm 265 of intermediate crank 200 interacts with first end 271 of switch lever 270 to cause switch lever 270 to rotate counter-clockwise about pivot 280, thereby causing second end 272 of switch lever 270 to disengage with status switch 260. In response to intermediate crank 200 being allowed to rotate counter-clockwise (with reference to FIGS. 9 and 12), switch lever 270 is biased via spring 275 to rotate clockwise about pivot 280, thereby causing second end 272 of switch lever 270 to engage with status switch 260. In an embodiment, the switching signal provided by status switch 260 provides control logic to the controller (not shown) via wires 261 and communication port 120 for the controller to timely provide a motor-off signal to motor 125. In another embodiment, the switching signal provided by status switch 260 also provides remote indication of the status of the main contacts 105.

For example, with ROCB drive system 115 engaged and a charge-and-close signal present at motor 125, drive system 115 operates in the manner described above to charge opening spring 135 and close the main contacts 105. In response to the blocking prop 190 releasing its temporary hold of second crank 180, intermediate crank 200 is now free to move under the influence of roller 206. With the movement of intermediate crank 200, not only are main contacts 105 committed to close, but also flag arm 255 and switch arm 265 are committed to drive status indicator 245 and status switch 260, respectively. It is this timely change of state of status switch 260 that provides logic to the controller to send a motor-off signal to motor 125, thereby stopping the motor 125 from continuing to run through another cycle.

Similarly, with ROCB drive system 115 engaged and an open signal present at motor 125, drive system 115 operates in the manner described above to discharge the stored energy in opening spring 135 to open the main contacts 105. In response to the intermediate crank 200 rapidly moving to drive the main contacts 105 open via roller 206, so the flag arm 255 and the switch arm 265 also rapidly move to disengage with the status indicator 245 and status switch 260, respectively. It is this timely change of state of status switch 260 that provides logic to the controller to send a motor-off signal to motor 125, thereby stopping the motor 125 from continuing to run through another cycle.

In view of the foregoing description, it will be appreciated that the status switch 260 is in operable communication with the intermediate crank 200 and is configured to indicate a closed main contact state in response to the operating mechanism 110 being in the on position and the main contacts 105 being closed, and is also configured to indicate an open main contact state in response to the operating mechanism 110 being in the on position and the main contacts 105 being held open via the ROCB drive system 115.

It will also be appreciated that in response to the operating mechanism 110 being in the on position and the main contacts 105 being driven open via the ROCB drive system 115 and the intermediate crank 200, the intermediate crank 200 is configured to reposition the status switch 260, thereby causing the status switch 260 to change state in response to operation of the motor 125 and to a change of state at the main contacts 105.

Figure 14:
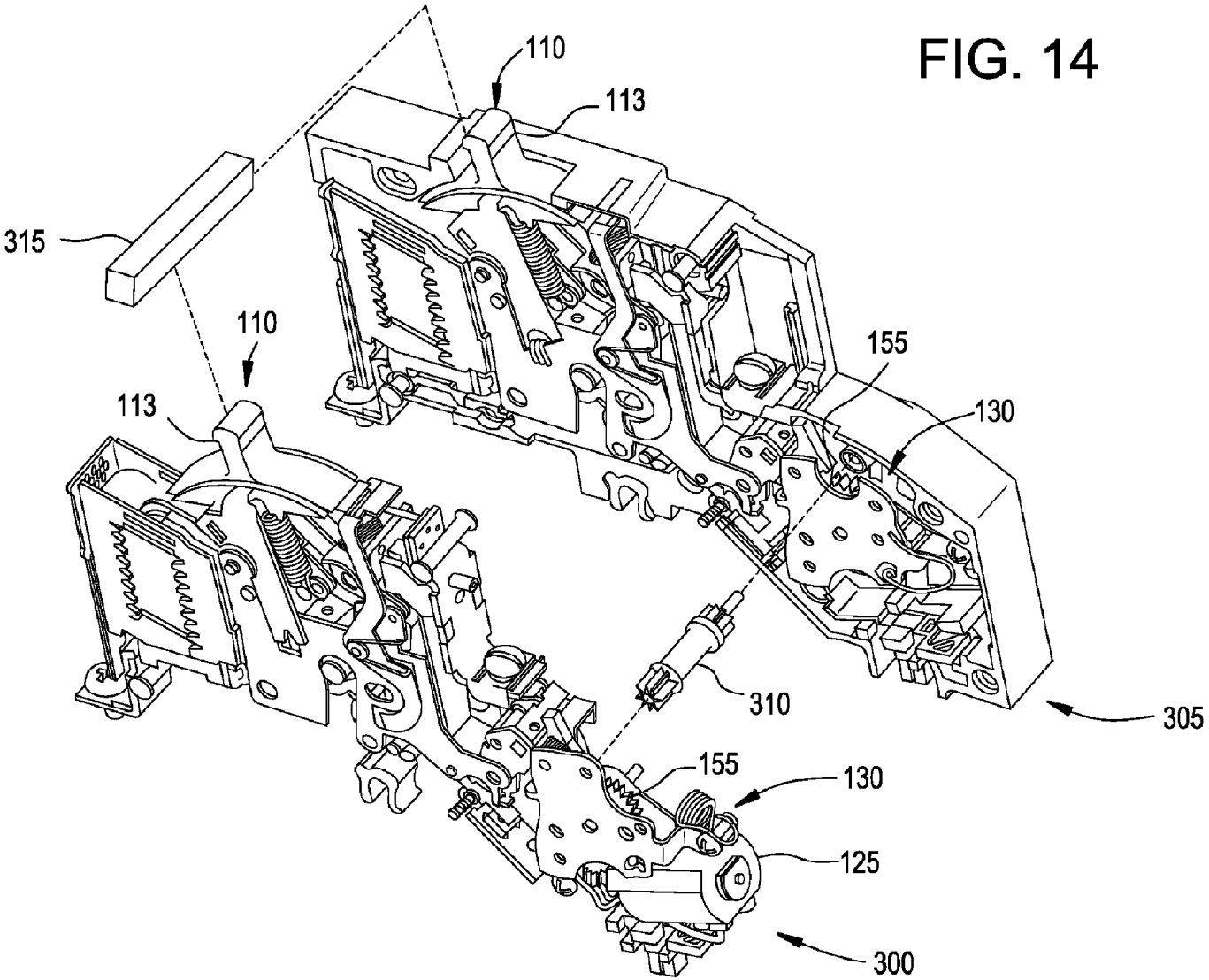
FIG. 14 depicts portions of a multi-pole ROCB in accordance with an embodiment of the invention.
Figure 15:
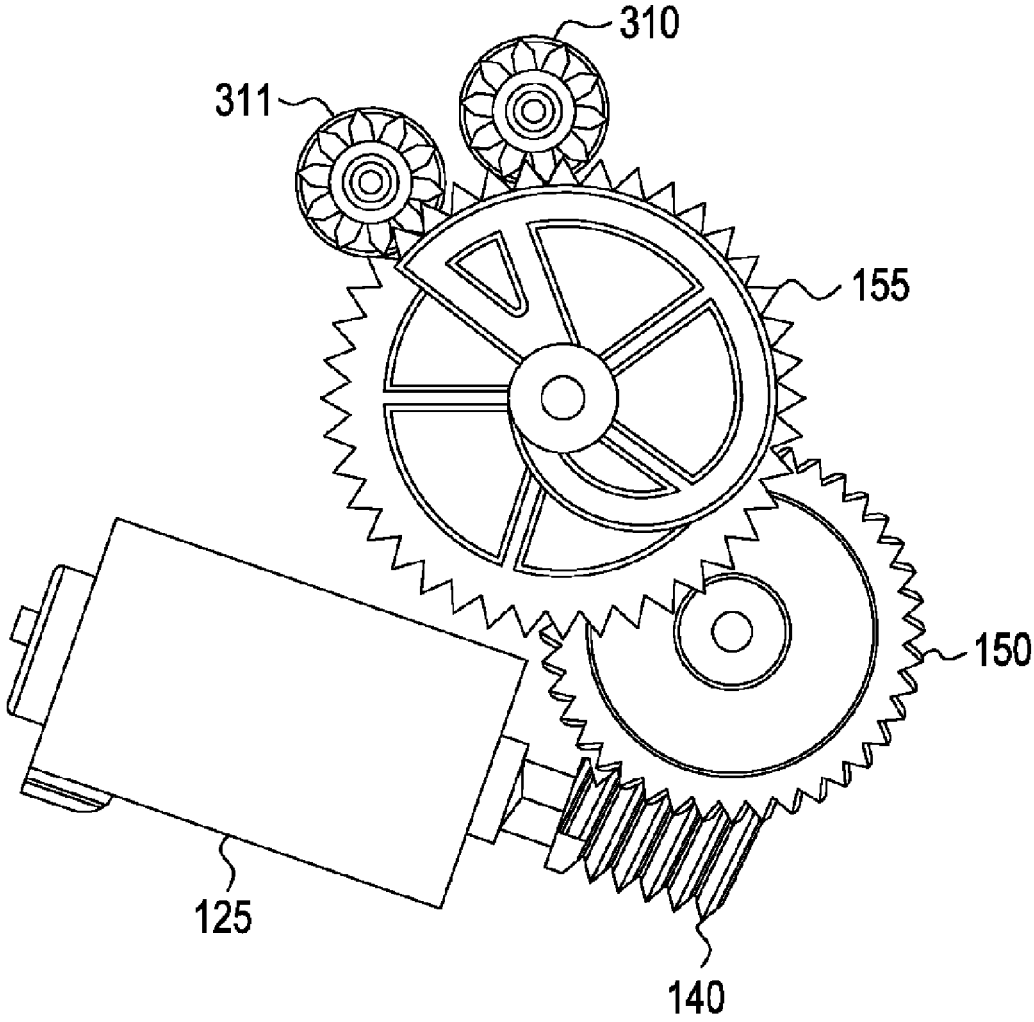
FIG. 15 depicts a portion of a multi-pole ROCB drive system in accordance with an embodiment of the invention.

As previously discussed and with reference now to FIG. 14 (left side isometric view), ROCB 100 may be of a single pole configuration or a multi-pole configuration. In a multi-pole configuration, ROCB 100 is configured with a master pole 300 and slave poles 305 (one slave pole on a two-pole breaker, and two slave poles on a three-pole breaker, for example), with the master pole 300 having a drive motor 125 and the slave poles being absent a motor 125. To provide mechanical ROCB drive from the master pole 300 to the slave pole 305, a connecting gear 310 is used to engage between the cam gears 155 of the primary drives 130. FIG. 15 (right side view) illustrates a three-pole configuration of partial primary drives 130 having two connecting gears 310 and 311. To provide mechanical connection between operating mechanisms 110 of the master and slave poles 300, 305, a mechanism handle tie 315 is used to mechanically tie the operating handles 113 together. By employing a single motor 125 in the master pole 300 and a connecting gear 310 between master and slave poles 300, 305, first and second control signals at motor 125 serve to remotely open and close the master and slave main contacts 105 separate from actuation of the master and slave operating mechanisms 110, in the manner previously discussed.

Figure 16:
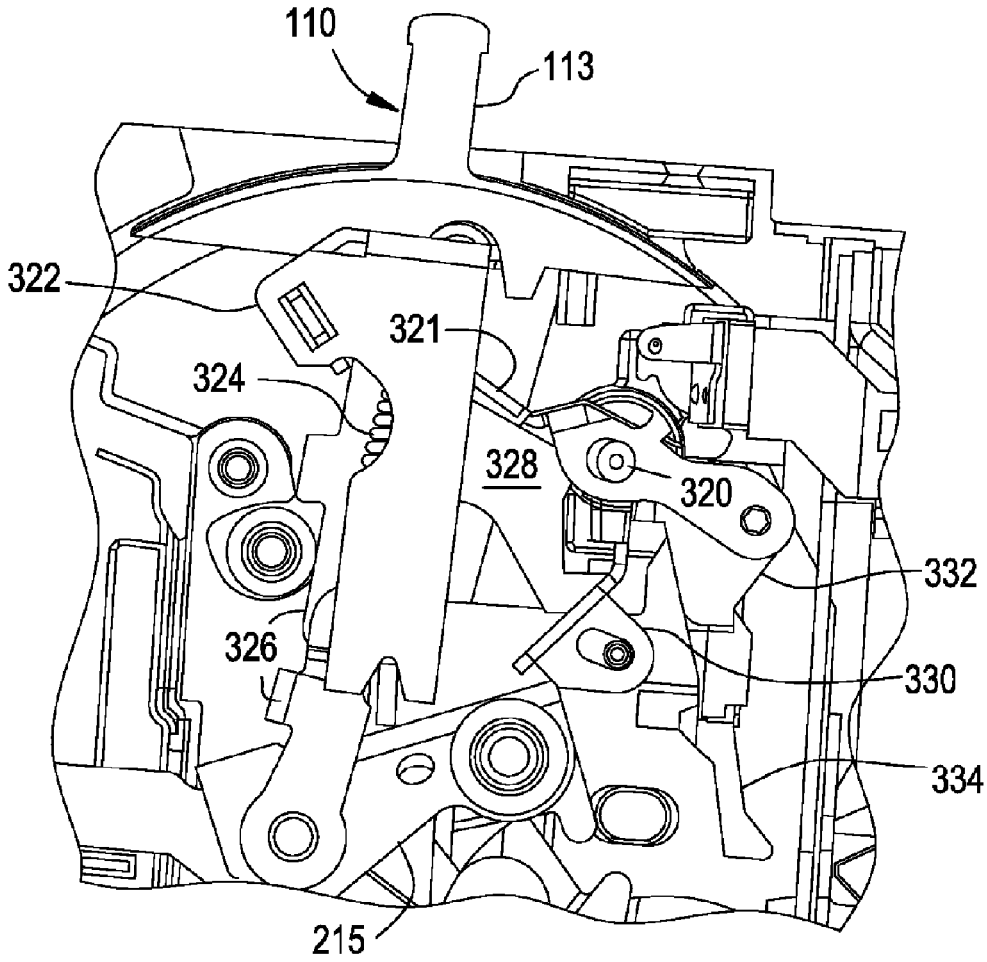
FIG. 16 depicts a portion of a breaker operating mechanism in accordance with an embodiment of the invention.
Figure 17:
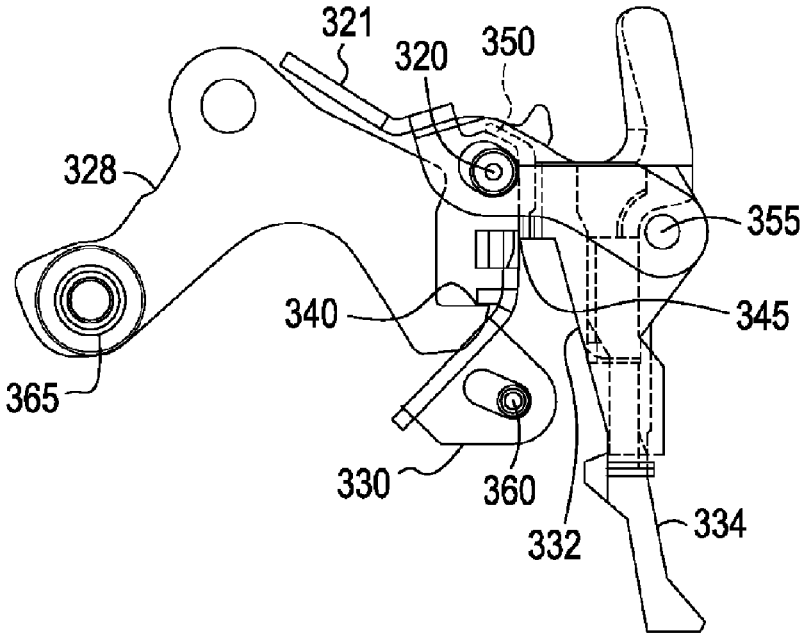
FIG. 17 depicts a portion of the operating mechanism of FIG. 16.
Figure 18:
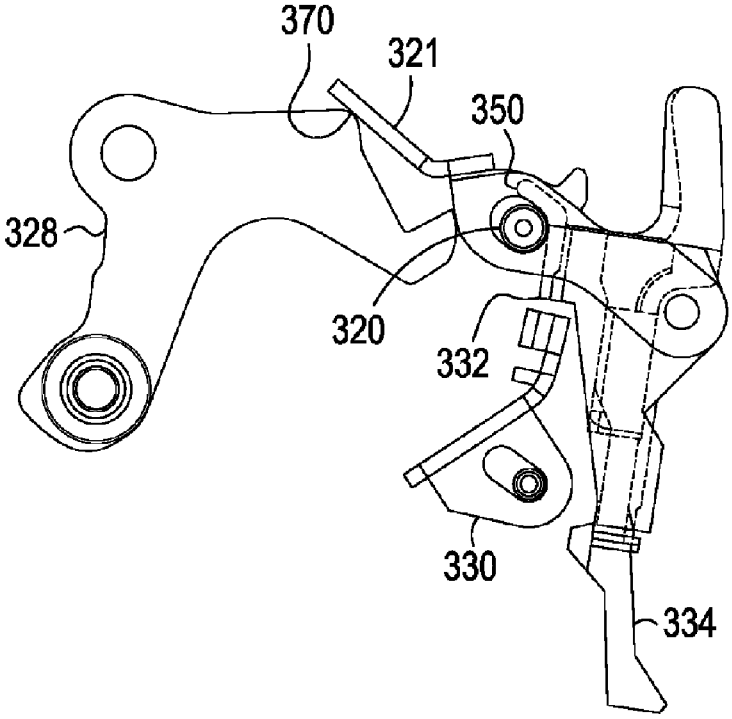
FIG. 18 depicts a view similar to that of FIG. 17, but with components in an alternative position.

To facilitate synchronized tripping of all poles of a multi-pole ROCB 100 and with reference now to FIGS. 16–18 (left side views), a common trip bar 320 and trip cam 321 are employed. Common trip bar 320 is common to all poles and is operably engaged with each trip cam 321 of each pole. FIG. 16 depicts a partial view of operating mechanism 110 having an operating handle 113, a handle yoke 322, mechanism springs 324, linkages 326, mechanism crank 215, cradle 328, primary latch 330, secondary latch 332, and trip lever 334, all of which operate in the manner described in aforementioned U.S. Pat. No. 4,679,016. Also depicted in FIG. 16 (and FIGS. 17–18) is common trip bar 320 and trip cam 321, which operate in a manner best described with reference now to FIGS. 17 and 18 that depict partial views of operating mechanism 110 in the latched position and the tripped position, respectively.

With reference first to FIG. 17 (latched condition), cradle 328 engages with primary latch 330 at engagement point 340, and primary latch 330 engages with secondary latch 332 at engagement point 345. In the latched condition, cradle 328 does not interface with trip cam 321, and common trip bar 320 does not interface with a tab 350 on secondary latch 332. Common trip bar 320 is in operable engagement with trip cam 321, such that common trip bar 320 moves in response to movement of trip cam 321. During a trip action, trip lever 334 and secondary latch 332 rotate clockwise about pivot 355 causing a separation at engagement point 345, primary latch 330 rotates clockwise about pivot 360 causing a separation at engagement point 340, and cradle 328 rotates counter-clockwise about pivot 365, resulting in a trip condition best seen by now referring to FIG. 18.

With reference now to FIG. 18, and during the aforementioned trip action, the counter-clockwise rotation of cradle 328 causes cradle 328 to engage with trip cam 321 at engagement point 370, which causes trip cam 321 to rotate clockwise about pivot 355 (common pivot with secondary latch 332), which causes common trip bar 320 to also move in a rotational path clockwise about pivot 355, which causes common trip bar 320 to engage with tab 350 on a secondary latch 332 of an adjacent pole, which results in synchronized tripping of all poles.

In view of the foregoing description, it will be appreciated that the common trip bar 320 is in operable communication with each operating mechanism 110 of each pole of a multi-pole ROCB 100 such that a trip action at one operating mechanism 110 results in a trip action at each operating mechanism 110 of the multi-pole ROCB 100.

In a multi-pole ROCB 100 where only a single motor 125 is employed to drive more than one set of gears in primary drives 130, such as that depicted in FIG. 14, the cam gears 155 need to be properly aligned from one pole to the next. To facilitate the proper alignment of the cam gears 155, a locking member (or alignment clip) 375 is employed in a slave pole 305, which is best seen by now referring to FIGS. 19 and 20 (left side views).

During the assembly of a master pole 300 and before the motor 125 is installed in housing 101, the cam gear 155 is rotated until the follower 165 is positioned against the drop-off shelf 161 of the cam 160, which is herein referred to as the set position. Once the cam gear 155 is in the set position, the motor 125, with worm drive 140 attached, is installed, thereby locking the master pole 300 in the set position.

Figure 19:
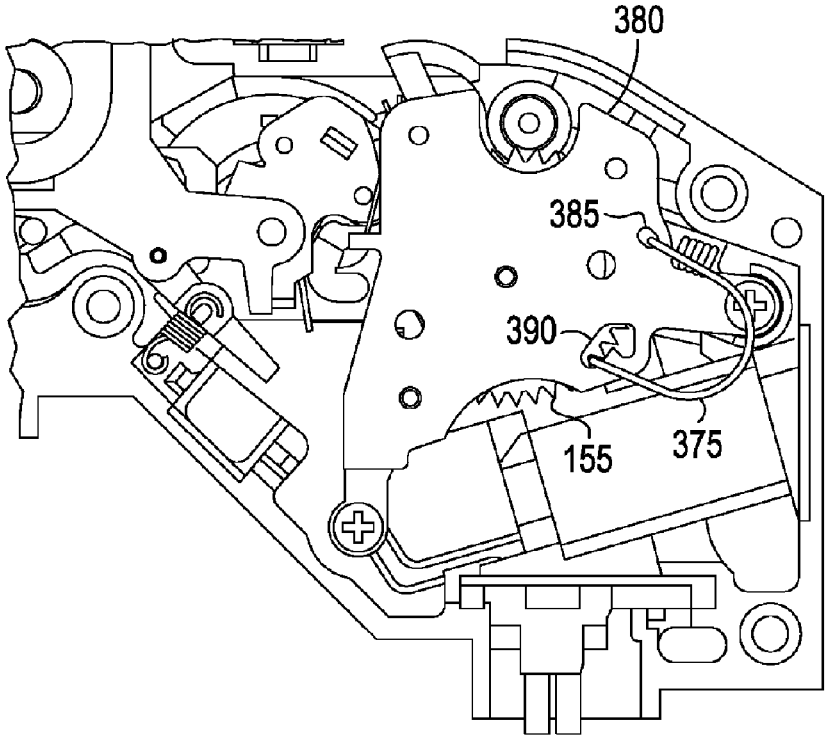
FIG. 19 depicts a locking member in accordance with an embodiment of the invention.
Figure 20:
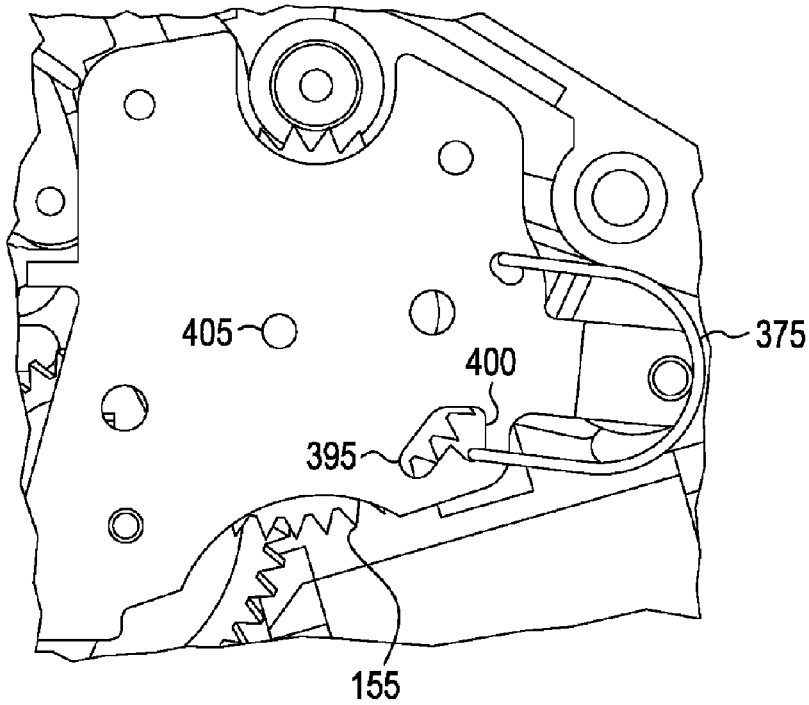
FIG. 20 depicts a view similar to that of FIG. 19, but with components in an alternative position.

During the assembly of the slave pole 305, which is absent a motor 125, the cam gear 155 is likewise rotated to the set position, and then the locking member 375 is installed in a first position that engages with and locks the cam gear 155 in place. This first locked position is depicted in FIG. 19. As part of the primary drive 130 of a slave pole 305, a gear support frame 380 is used to not only support the various gears, but also to provide spring supports 385, 390 for receiving the spring ends of locking member 375. In an embodiment, spring support 385 is a single hole, and spring support 390 is a bilobular hole having a first lobe 395 disposed proximate teeth of cam gear 155 and a second lobe 400 disposed away from teeth of cam gear 155. As seen by referring to FIGS. 19 and 20 together, when locking member 375 is disposed at first lobe 395 (FIG. 19), cam gear 155 is retrained by locking member 375 (locking member 375 is in contact with the teeth of cam gear 155 and is said to be in a first locked position), and when locking member 375 is disposed at second lobe 400 (FIG. 20), cam gear 155 is unrestrained by locking member 375 (locking member 375 is in clearance with the teeth of cam gear 155 and is said to be in a second unlocked position). With cam gear 155 in the set position and locking member 375 in the first locked position, slave pole 305 can be assembled with master pole 300 with the respective cam gears 155 being properly aligned and then interconnected via the connecting gear 310. During a first operation of motor 125, cam gear 155 of slave pole 305 is rotated counter-clockwise about its pivot 405 (with reference to FIGS. 19 and 20), which causes locking member 375 to be driven by the teeth of cam gear 155 out of first lobe 395 (FIG. 19) and to be spring loaded into second lobe 400 (FIG. 20), thereby resulting in cam gear 155 no longer being locked, and locking member 375 no longer being in operable communication with the teeth of cam gear 155.

As disclosed, some embodiments of the invention may include some of the following advantages: a unidirectional drive system for remotely operating a circuit breaker; an opening spring for a ROCB configured to open the main contacts independent of the speed of the driving motor and gears that charge the spring; a multi-pole ROCB having a single drive motor; a self-disengaging locking member for proper alignment of the gears of a multi-pole ROCB; a blocking prop for a ROCB configured close the main contacts independent of the speed of the driving motor; a unidirectional drive system for a ROCB capable of producing a quick-make and quick-break action at the main contacts; a decoupler for engaging and disengaging the ROCB drive system depending on the position of the breaker operating mechanism; a common trip bar for synchronized common tripping; a status indicator for providing visual indication as to the status of the main contacts regardless of whether the main contacts are actuated locally or remotely; a status switch for providing logical control for powering the motor on and off; and, a status switch for providing remote indication as to the status of the breaker main contacts.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A circuit breaker configured to be remotely operated, comprising:

a set of main contacts configured to connect between an electrical source and an electrical load;

an operating mechanism in operable communication to open and close the main contacts; and a remotely operable drive system configured to open and close the main contacts separate from actuation of the operating mechanism, the drive system comprising:

a motor responsive to first and second control signals;

a primary drive responsive to the motor; and an opening spring responsive to the primary drive, the main contacts being responsive to the opening spring;

wherein in response to the first control signal the primary drive moves to charge the opening spring, and in response to the second control signal and the main contacts being closed, the primary drive moves to allow the opening spring to discharge thereby resulting in the main contacts opening independent of the motor.

2. The circuit breaker of claim 1, wherein the drive system is configured to open and close the main contacts in response to the operating mechanism being in the on position.

3. The circuit breaker of claim 1, wherein the primary drive comprises a unidirectional gear drive.

4. The circuit breaker of claim 1, wherein the motor comprises a unidirectional motor; and the primary drive further comprises:

a cam in operable communication with the motor; and a cam follower in operable communication with the cam, the opening spring being responsive to the cam follower;

wherein in response to the first control signal the motor drives the cam thereby resulting in the cam follower charging the opening spring, and in response to the second control signal the motor drives the cam further in the same direction thereby resulting in the cam follower allowing the opening spring to discharge.

5. The circuit breaker of claim 4, wherein:

the cam comprises a profile having a drop-off shelf, such that in response to the cam follower traversing the drop-off shelf, the opening spring is allowed to rapidly discharge independent of the speed of the motor.

6. The circuit breaker of claim 1, wherein the drive system further comprises:

a drive crank responsive to the motor and the opening spring, and configured to close the main contacts in response to the first control signal; and a blocking prop disposed to temporarily block the action of the drive crank from closing the main contacts;

wherein in response to the first control signal the drive crank moves in a direction to charge the opening spring, and in response to the opening spring being fully charged, the blocking prop is caused to release its temporary block of the drive crank thereby allowing the drive crank to cause the main contacts to close.

7. The circuit breaker of claim 6, wherein:

in response to the blocking prop releasing its temporary block of the drive crank, the main contacts are allowed to close independent of the speed of the motor.

8. The circuit breaker of claim 6, wherein the drive crank comprises:

a first crank in operable communication with the motor and the opening spring;

a second crank in operable communication with the first crank and the blocking prop; and a contact spring disposed to bias the main contacts closed;

wherein in response to the first control signal, the motor causes the first crank to move in a direction to charge the opening spring, the blocking prop serves to temporarily block movement of the second crank, and in response to the opening spring being fully charged, the motor causes the blocking prop to release its temporary block of the second crank thereby allowing the stored energy in the contact spring to cause the main contacts to close.

9. The circuit breaker of claim 4, wherein the motor further comprises a gear drive operably attached to the motor drive shaft, wherein the cam is operably responsive to movement of the gear drive.

10. The circuit breaker of claim 9, wherein the gear drive comprises a worm drive, and the primary drive further comprises:

a worm gear in operable communication with the worm drive; and a cam gear in operable communication with the worm gear, the cam and cam gear being integrally arranged.

11. The circuit breaker of claim 1, further comprising:

a drive crank responsive to the motor;

an intermediate crank responsive to the drive crank; and a contact arm responsive to the intermediate crank, the contact arm operable to open and close the main contacts;

wherein in response to the second control signal and the stored energy in the opening spring, the drive crank is configured to rapidly move to drive and hold the intermediate crank, which is configured to drive and hold the contact arm to hold open the main contacts.

12. The circuit breaker of claim 11, further comprising a contact spring disposed to bias the main contacts closed in response to the operating mechanism being in the on position, wherein:

in response to the first control signal, the main contacts being held open, and the operating mechanism being in the on position, the drive crank is responsive to the motor to rapidly release its hold on the intermediate crank, thereby resulting in rapid closure of the main contacts under the biasing influence of the contact spring.

13. The circuit breaker of claim 1, further comprising:

a contact arm assembly responsive to the drive system and the operating mechanism, the contact arm assembly operable to open and close the main contacts; and a decoupler in operable communication with the drive system and the contact arm assembly;

wherein in response to the operating mechanism being in the on position, the decoupler allows engagement of the drive system with the contact arm assembly;

wherein in response to the operating mechanism being in the off position, the decoupler disallows engagement of the drive system with the contact arm assembly;

wherein in response to the operating mechanism being in the off position and the motor being responsive to the first or the second control signal, the contact arm assembly is non-responsive to the drive system.

14. The circuit breaker of claim 13, wherein:

the contact arm assembly comprises a mechanism crank, a contact arm, and a contact spring disposed to bias the main contacts closed in response to the operating mechanism being in the on position; and the decoupler is in operable communication with the mechanism crank.

15. The circuit breaker of claim 14, wherein:

the drive system further comprises a drive crank responsive to the motor and configured to close the main contacts in response to the first control signal; and the decoupler is in operable communication with the drive crank.

16. The circuit breaker of claim 15, wherein the drive crank comprises:

a first crank in operable communication with the motor and the opening spring;

a second crank in operable communication with the first crank;

a crank spring disposed to bias the second crank to move in the same direction as the first crank; and a drive plate disengagably biased to engage the first crank with the second crank;

wherein the decoupler is in operable communication with the drive plate such that in response to the operating mechanism being in the on position, the decoupler allows the drive plate to engage the first crank with the second crank, and in response to the operating mechanism being in the off position, the decoupler disallows the drive plate to engage the first crank with the second crank.

17. The circuit breaker of claim 16, wherein:

the drive system further comprises a blocking prop disposed to temporarily block the action of the drive crank from closing the main contacts; and the decoupler is in operable communication with the blocking prop such that in response to the operating mechanism being in the on position, the decoupler allows the blocking prop to temporarily block the action of the drive crank in response to the drive crank moving in a direction so as to cause the main contacts to close, and in response to the operating mechanism being in the off position, the decoupler disallows the blocking prop to temporarily block the action of the drive crank in response to the drive crank moving in a direction so as to cause the main contacts to close.

18. The circuit breaker of claim 11, further comprising:

a status indicator in operable communication with the intermediate crank and configured to indicate a closed main contact condition in response to the operating mechanism being in the on position and the main contacts being closed, and to indicate an open main contact condition in response to the operating mechanism being in the on position and the main contacts being hold open.

19. The circuit breaker of claim 11, further comprising:

a status indicator biased in a first direction and in operable communication with the intermediate crank;

wherein in response to the operating mechanism being in the on position and the main contacts being closed, the intermediate crank is configured to drive the status indicator in a second direction opposite to the first direction, thereby indicating a closed main contact condition; and wherein in response to the operating mechanism being in the an position and the main contacts being held open via the intermediate crank, the intermediate crank is configured to allow the status indicator to move in the first direction, thereby indicating an open main contact condition.

20. The circuit breaker of claim 11, further comprising:

a status switch in operable communication with the intermediate crank and configured to indicate a closed main contact state in response to the operating mechanism being in the on position and the main contacts being closed, and to indicate an open main contact state in response to the operating mechanism being in the on position and the main contacts being held open.

21. The circuit breaker of claim 11, further comprising:

a status switch in operable communication with the intermediate crank;

wherein in response to the operating mechanism being in the on position and the main contacts being closed, the intermediate crank is configured to position the status switch in a first state; and wherein in response to the operating mechanism being in the on position and the main contacts being held open via the intermediate crank, the intermediate crank is configured to position the status switch in a second state, thereby causing the status switch to change state in response to operation of the motor and to a change of state at the main contacts.

22. The circuit breaker of claim 17, wherein:

in response to the operating mechanism being in the off position, the decoupler allows the crank spring to bias the second crank to move in the same direction as the first crank.

* * * * *

UNITED STATES PATENT AND TRADEMARK OFFICE

CERTIFICATE OF CORRECTION

PATENT NO. : 7,061,349 B2
APPLICATION NO. : 10/907202
DATED : June 13, 2006
INVENTOR(S) : Roger Castonguay It is certified that error appears in the above-identified patent and that said Letters Patent is hereby corrected as shown below:

Column 10,
Line 52, before "by", delete "retrained" and insert therefor --restrained--.

Column 14,
Line 32, after "the" (first occurrence), delete "an" and insert therefor --on--.

Signed and Sealed this

Twenty-first Day of November, 2006

JON W. DUDAS
*Director of the United States Patent and Trademark Office*